US009970177B2

(12) United States Patent
Koestler et al.

(10) Patent No.: US 9,970,177 B2
(45) Date of Patent: May 15, 2018

(54) QUICK COUPLER HAVING SPRING APPLIED, HYDRAULICALLY RELEASED PRIMARY AND SECONDARY LOCK MEMBERS MOUNTED ON SAME CROSS SHAFT

(71) Applicant: Deere & Company, Moline, IL (US)

(72) Inventors: Adam J. Koestler, Asbury, IA (US); Jason M. Simmons, Platteville, WI (US); Daniel M. Sulzer, Dubuque, IA (US); Mark Nier, New Holstein, WI (US); Cory Ott, Dubuque, IA (US)

(73) Assignee: Deere & Company, Moline, IL (US)

( * ) Notice: Subject to any disclaimer, the term of this patent is extended or adjusted under 35 U.S.C. 154(b) by 404 days.

(21) Appl. No.: 14/702,911

(22) Filed: May 4, 2015

(65) Prior Publication Data

US 2016/0326712 A1 Nov. 10, 2016

(51) Int. Cl.
*E02F 3/36* (2006.01)

(52) U.S. Cl.
CPC ..... *E02F 3/3663* (2013.01); *E02F 3/364* (2013.01); *E02F 3/365* (2013.01); *E02F 3/3613* (2013.01); *E02F 3/3631* (2013.01); *E02F 3/3609* (2013.01); *Y10T 403/591* (2015.01); *Y10T 403/599* (2015.01)

(58) Field of Classification Search
CPC ..... Y10T 403/591; Y10T 403/593; Y10T 403/598; Y10T 403/599; Y10T 403/602; E02F 3/3609; E02F 3/3613; E02F 3/3631; E02F 3/364; E02F 3/365; E02F 3/3663
USPC ..... 403/322.1, 322.3, 324, 325, 327; 414/723; 37/468; 172/272
See application file for complete search history.

(56) References Cited

U.S. PATENT DOCUMENTS 5,082,389 A * 1/1992 Balemi ..... E02F 3/3622 37/468
5,147,173 A * 9/1992 Fauber ..... E02F 3/3627 172/273
5,179,794 A * 1/1993 Ballinger ..... E02F 3/3622 172/272
5,890,871 A * 4/1999 Woerman ..... E02F 3/3627 37/468
6,260,357 B1 7/2001 Goodfellow et al.
(Continued)

*Primary Examiner* — Josh Skroupa
*Assistant Examiner* — Cory B Siegert

(57) ABSTRACT

A quick coupler primary lock arrangement includes a fore-and-aft guided wedge arrangement carried by a cross shaft and is biased forwardly to a lock position by a first spring arrangement, and includes a secondary lock arrangement includes a locking pawl arrangement pivotally mounted to the cross shaft and biased, by a second spring arrangement, to a secondary lock position wherein the pawl arrangement includes a surface disposed in a confronting locking disposition relative to an abutment surface of a fixed plate of the coupler to thereby prevent rearward movement of the wedge arrangement from the lock position. A normally depressurized hydraulic cylinder is coupled to the pawl arrangement and when selectively pressurized overcomes spring biasing forces and pivots the pawl arrangement from the secondary locking position and then shifts the wedge arrangement rearward to a coupler release position. An electro-hydraulic control arrangement prevents unintentional operation of the hydraulic cylinder.

22 Claims, 8 Drawing Sheets

(56) References Cited

U.S. PATENT DOCUMENTS

| | | | | |
|---|---|---|---|---|
| 6,379,075 | B1 * | 4/2002 | Shamblin | E02F 3/3613 37/468 |
| 6,487,800 | B1 * | 12/2002 | Evans | E02F 3/3627 37/468 |
| 6,964,122 | B2 * | 11/2005 | Cunningham | E02F 3/3618 37/468 |
| 7,654,019 | B2 * | 2/2010 | Yeager | E02F 3/364 37/468 |
| 8,585,314 | B2 * | 11/2013 | Morin | E02F 3/3627 37/468 |
| 8,602,676 | B2 | 12/2013 | Stollery | |
| 8,862,274 | B2 | 10/2014 | Reiter et al. | |
| 2003/0175072 | A1 * | 9/2003 | Steig, Jr. | E02F 3/3618 403/322.1 |
| 2007/0166143 | A1 * | 7/2007 | Hart | E02F 3/3618 414/723 |
| 2016/0002877 | A1 * | 1/2016 | Pesch | E02F 3/3618 37/468 |

* cited by examiner

QUICK COUPLER HAVING SPRING APPLIED, HYDRAULICALLY RELEASED PRIMARY AND SECONDARY LOCK MEMBERS MOUNTED ON SAME CROSS SHAFT

TECHNICAL FIELD

The present application relates generally to hydraulically operable quick couplers for securing working implements or attachments to an excavator boom or arm.

BACKGROUND

Excavators are equipped with booms or arms to which a variety of working implements or attachments may be secured to perform different tasks. In order to make attaching and detaching these implements to the excavator booms or arms as simple and speedy as possible, various quick coupler systems have been designed. Some of these use a spring-applied, hydraulically released wedging system for effecting a secure connection between the attachment and the boom. Further, it is desirable to have these quick coupler systems operate reliably and intentionally in order to prevent the attachments from accidentally becoming detached and possibly causing harm to people or equipment located in the vicinity of the tool being used.

Thus, it is desired that a quick coupler system be provided that includes primary and secondary lock systems constructed with relatively simple, inexpensive components which are easy to assemble.

SUMMARY

According to a first aspect, the disclosed quick coupler includes a compact arrangement wherein major components of a spring-applied, hydraulically released wedging lock include primary and secondary lock components comprising first and second wedge members of the primary lock and at least one latching pawl of the secondary lock all directly connected to a transverse cross shaft.

According to a second aspect, the hydraulic actuator of the aforementioned quick coupler is coupled directly to the at least one latching pawl which is pivotally mounted to the cross shaft, the first and second wedge members are supported for fore-and aft movement within guide slots provided in opposite side members of the quick coupler, a first spring arrangement is coupled for biasing the wedge members forwardly in the guide slots and to maintain the wedge members in wedged engagement with wedge-shaped recesses provided in rear edges of a work attachment mounting bracket when the quick coupler is coupled to the bracket, a second spring arrangement is coupled for biasing the at least one latching pawl to a position for effecting the secondary lock, the hydraulic cylinder being coupled directly to the at least one latching pawl and being retracted for releasing the quick coupler from the working attachment bracket, with initial retraction resulting in the at least on latching pawl of the secondary lock being pivoted about the cross shaft to an unlocked position wherein the cross shaft is located along a line of action of the hydraulic cylinder and with further retraction resulting in the cross shaft being shifted rearwardly so as to move the wedge members rearwardly from wedged engagement with the attachment mounting bracket.

According to a third aspect, the compact arrangement of the primary and secondary lock components set forth above are entirely located within approximately a rear half of the quick coupler.

These and other aspects of the quick coupler will become apparent from a reading of the following description together with the appended drawings.

BRIEF DESCRIPTION OF THE DRAWINGS

The detailed description of the drawings refers to the accompanying figures in which.

DETAILED DESCRIPTION OF THE DRAWINGS

At least one example embodiment of the subject matter of this disclosure is understood by referring to FIGS. 1 through 6 of the drawings.

Figure 1:
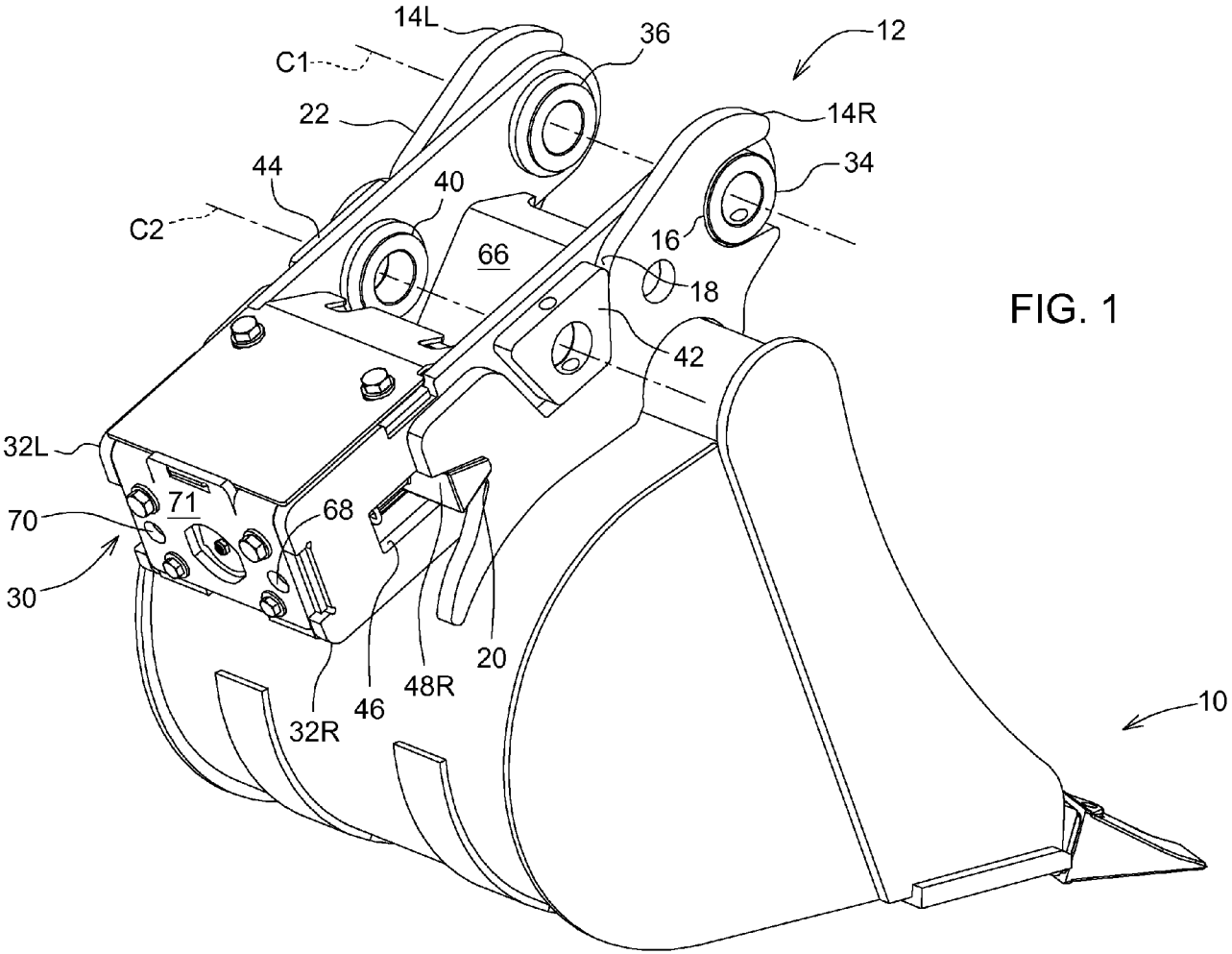
FIG. 1 is a perspective view of a work implement embodied as an excavator bucket and showing a quick coupler attached to a mounting bracket of the excavator bucket.

Referring now to FIG. 1, there is shown a working implement embodied here as an excavator bucket 10 having an upper central region provided with a mounting bracket 12 including right and left transversely spaced, fore-and-aft extending, vertical mounting plates 14R and 14L having forward ends respectively provided with forwardly opening, transversely aligned, generally C-shaped recesses 16, having upper edges respectively provided with upwardly opening, transversely aligned wedge-shaped recesses 18 (only the wedge-shaped recess 18 of the plate 14R being visible) located intermediate front and rear ends of the mounting plates 14R and 14L and having rearwardly opening, transversely aligned wedge-shaped recesses 20 respectively provided in rear edges of the mounting plates (only the wedge-shaped recess 20 of the plate 14R being visible).

Figure 2:
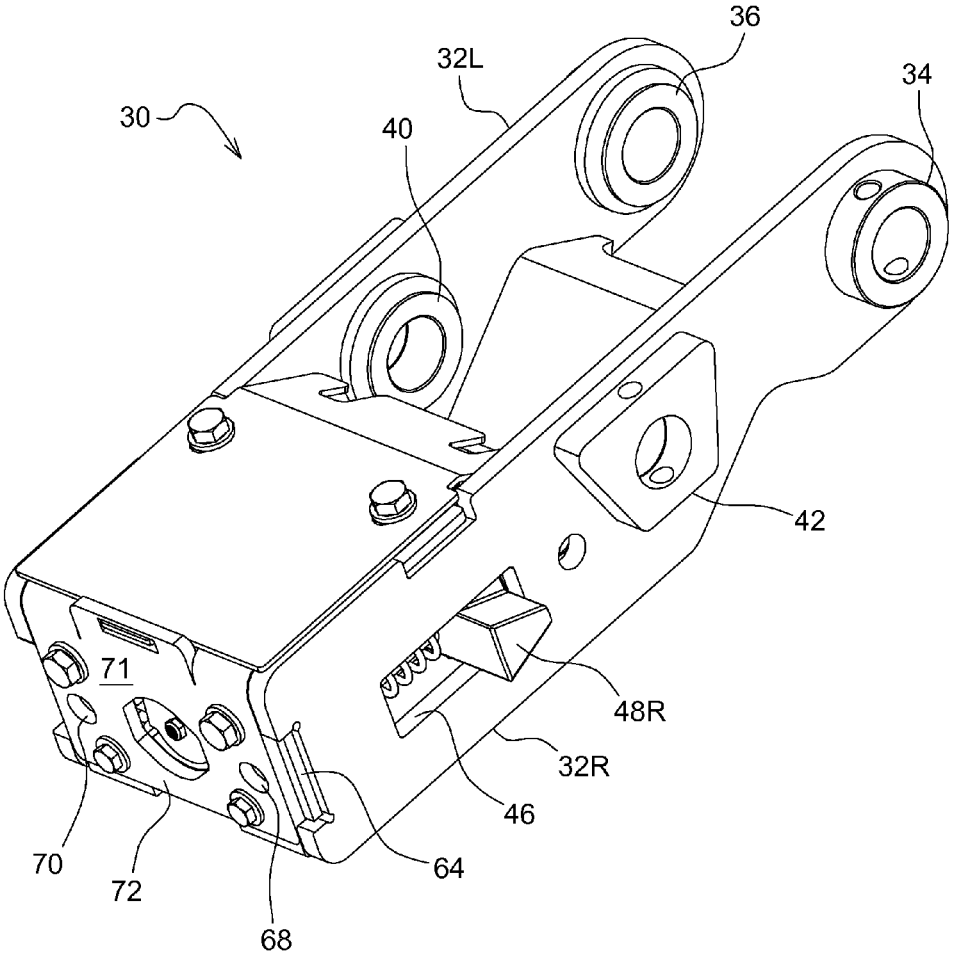
FIG. 2 is a right rear perspective view of the quick coupler shown in FIG. 1.
Figure 3:
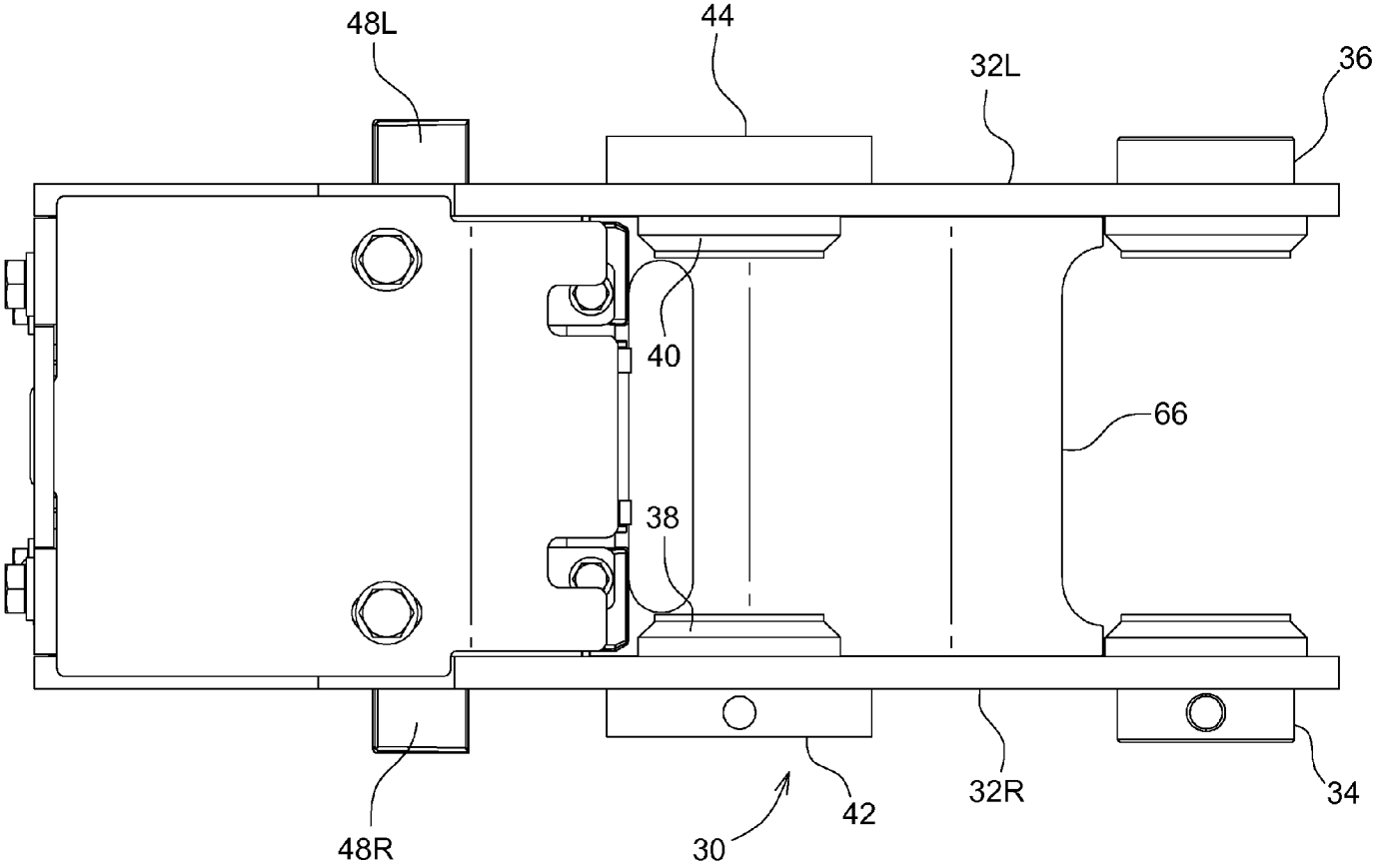
FIG. 3 is a top view of the quick coupler shown in FIG. 2.

A quick coupler 30 is shown mounted to the bucket mounting bracket 12 in a fully-engaged position. Referring now also to FIGS. 2 and 3, it can be seen that the quick-coupler 30 includes right and left vertical side plates 32R and 34L respectively positioned along inner surfaces of the bracket plates 14R and 14L, with forward ends of the side plates 32R and 32L being respectively provided with cylindrical sleeves 34 and 36 that are axially aligned along a first transverse coupling axis C1 having outer regions extending outwardly from the side plates and seated in the C-shaped recesses 16, with the sleeves 34 and 36 being adapted for receiving a coupling pin for securing the bucket 10 to the end of an excavator arm or boom (not shown), as is well known. The vertical side plates 32R and 32L are respectively provided with cylindrical sleeves 38 and 40 located at intermediate locations between opposite ends of the side plates and having respective outer ends joined to downwardly converging, wedge-shaped portions 42 and 44, the sleeves and wedge-shaped portions being transversely aligned with each other along a second coupling axis C2 and with the wedge-shaped portions respectively being seated in the wedge-shaped recesses 18 and together with the cylindrical sleeves being adapted for receiving a mounting pin for mounting one end of a hydraulic bucket tilt cylinder (not shown) to the quick coupler 30, as is well known. Identical, fore-and-aft extending, rectangular guide slots 46 are respectively provided in each of the side plates 32R and 32L at locations spaced rearward of the coupling axis C2, with the guide slots being in parallel relationship to, and below, a plane containing the coupling axes C1 and C2, noting that only the guide slot 46 provided in the right side plate 32R is visible. Projecting outwardly through the guide slots 46 are forwardly converging right and left wedge sections 48R and 48L, which form part of a primary lock arrangement described in more detail below, with the wedge sections being respectively seated in the wedge-shaped recesses 20 provided in the rear edges of the mounting bracket plates 14R and 14L.

Figure 4:
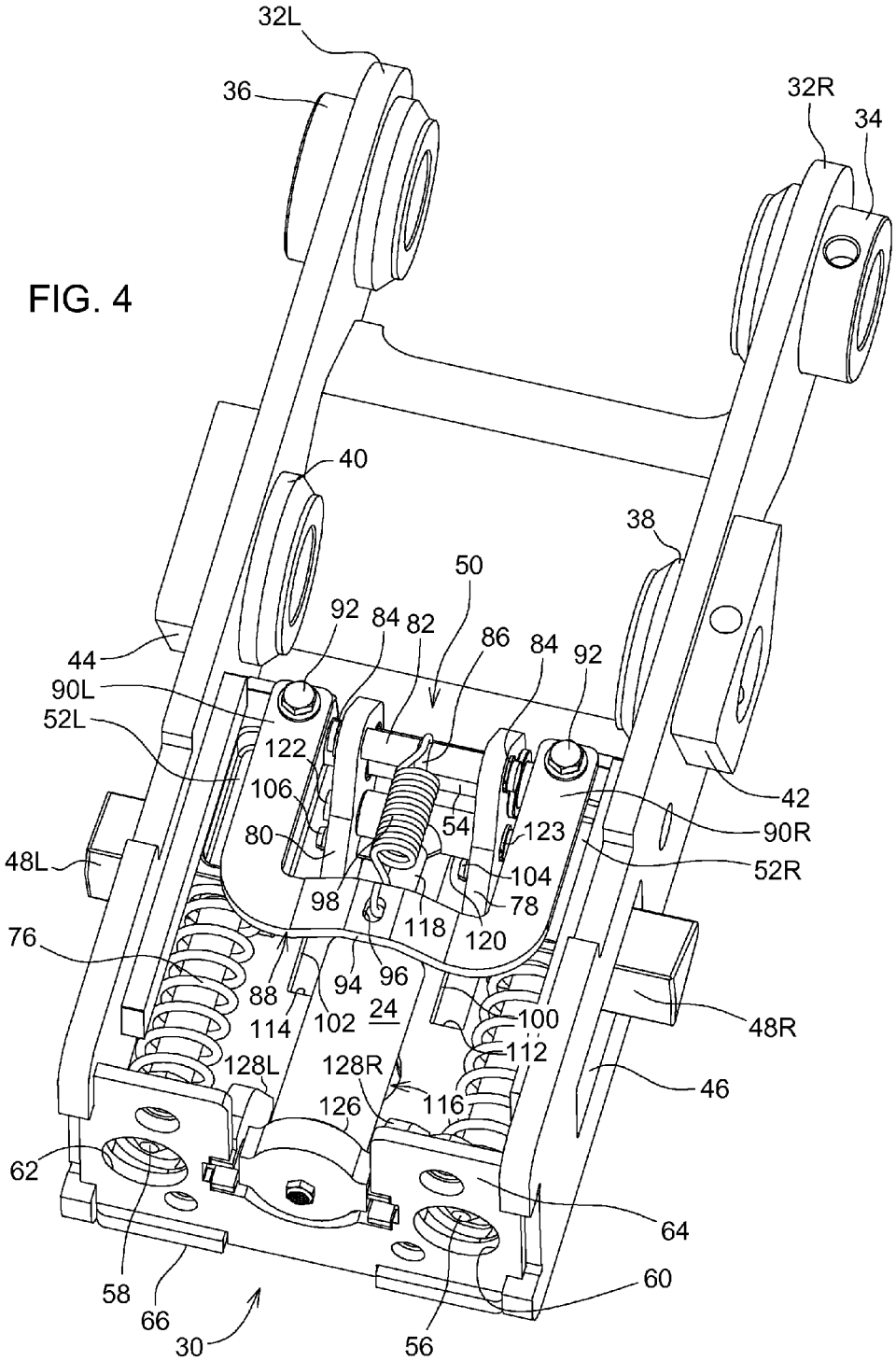
FIG. 4 is a top rear perspective view of the quick-coupler shown in FIG. 1, but with an L-shaped cover plate removed exposing a hydraulically operated latch mechanism.
Figure 5:
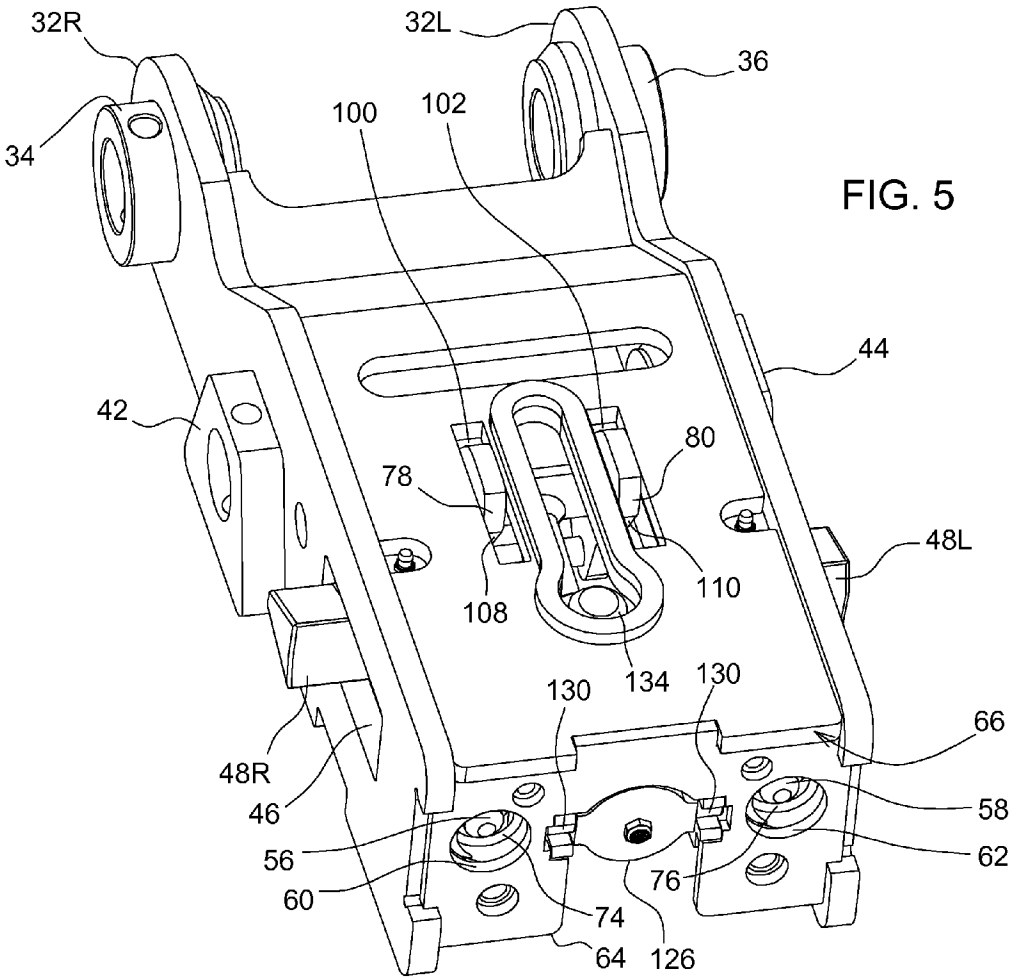
FIG. 5 is a right rear perspective view of the bottom of the quick coupler shown in FIG. 4.
Figure 6:
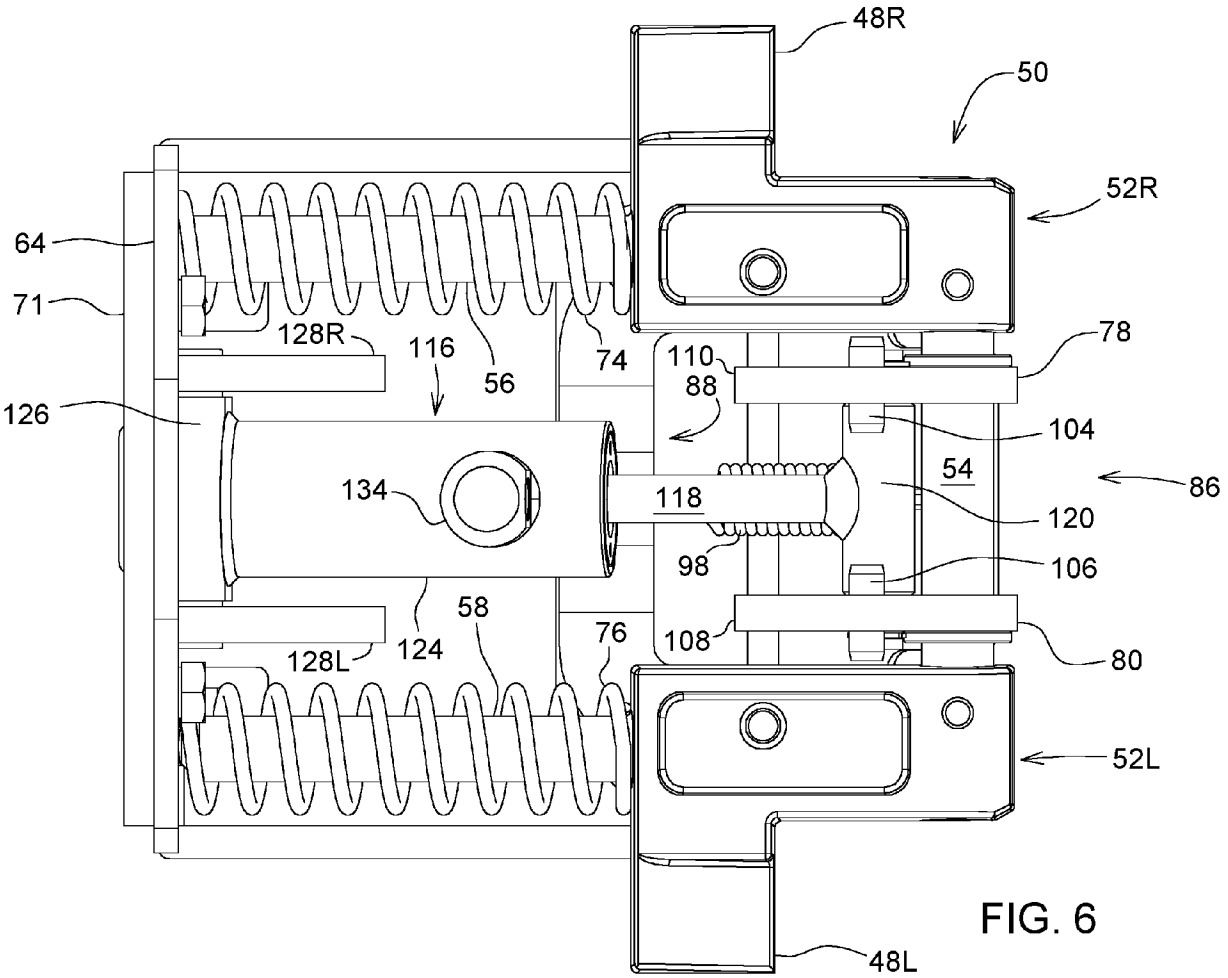
FIG. 6 is a bottom view of the hydraulically operated latch mechanism together with the mounting structure for the barrel of the hydraulic cylinder.

Referring now also to FIGS. 4-6, it can be seen that the wedge sections 48R and 48L form part of a compact, spring-applied, hydraulically released latch mechanism 50 which, with the exception of right and left end regions of the wedge sections 48R and 48L, are located between the side plates 32R and 32L in a rear half of the quick coupler 30. Specifically, the wedge sections 48R and 48L form outturned portions of parallel right and left, right angular wedge members 52R and 52L having respective forward ends received on opposite ends of a cross shaft 54 extending parallel to the first and second coupling axes C1 and C2. As can best be seen in FIGS. 4 and 6, respective forward ends of fore-and-aft extending spring guide rods 56 and 58 are fixed integrally with rear sides of the right-angular wedge members 52R and 52L, with the rods 56 and 58 being respectively in axial alignment circular openings 60 and 62 provided in an interior upright plate 64 fixed to rear end regions of the side plates 32R and 32L and having respective tabs fitted into notches provided in rear ends of the opposite side plates 32R and 32L and in a central rear end location of a transverse plate 66 bent into a shape to conform to, and being fixed between, rear end and bottom regions of the side plates 32R and 32L. An L-shaped plate 72 is located between the side plates 32R and 32L and includes horizontal and vertical legs 69 and 70, respectively defining an upper rear corner of the coupler 30. The rods 56 and 58 are respectively axially aligned with circular holes 68 and 70 provided in an upright rear portion 71 of an L-shaped plate 72 (FIGS. 1 and 2) releasably fixed across the interior upright plate 64. Coil compression springs 74 and 76 are respectively received on the spring guide rods 56 and 58 and are compressed between the interior upright plate 64 and the wedge members 52R and 52L so as to bias the latter forwardly, noting that when the quick coupler is disconnected from the bucket 10 or other working attachment, the wedge sections 48R and 48L are biased to a fully forward position, as can be seen in each of FIGS. 2-5, wherein they are respectively engaged with forward ends of the slots 46. However, when the wedge sections 48R and 48L are in a locking position, as shown in FIG. 1, they are positioned rearwardly of the forward ends of the slots 46, with the springs 74 and 76 exerting a biasing force wedgingly engaging the wedge sections with the wedge-shaped recesses 20 provided in the rear edges of the vertical side plates 14R and 14L of the bucket mounting bracket 12 with sufficient force to keep the quick coupler cylindrical sleeves 34 and 36 seated within the mounting bracket recesses 16 and the quick coupler wedge-shaped sections 42 and 44 seated in bracket wedge shaped recesses 18.

Figure 7:
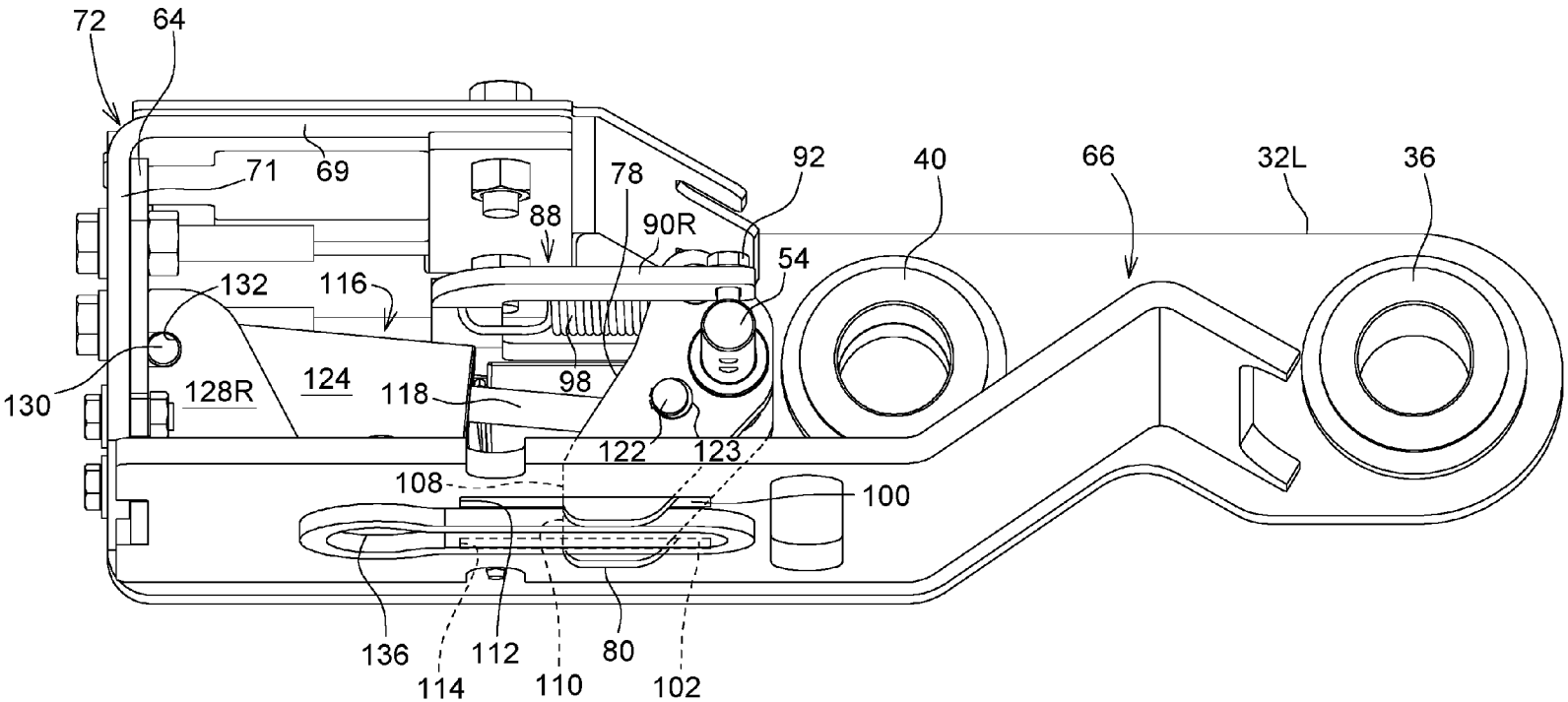
FIG. 7 is a right bottom perspective of the quick-coupler shown in FIG. 1, but with the right side plate and right wedge member removed so as to expose the hydraulic cylinder for placing the primary and secondary locks in unlocked positions.

Located on the cross shaft 54 at respective locations spaced inward of the wedge members 52R and 52L are fore-and-aft extending latches or pawls 78 and 80 in the form of vertical plates having forward middle sections pivotally mounted on the cross shaft 54. As can best be seen in FIGS. 4 and 7, a horizontal spring mounting rod 82 has opposite end regions respectively received in axially aligned, transverse holes provided in the latches 78 and 80 at locations spaced upwardly and to the rear from the cross shaft 54, as viewed in FIG. 7, the rod being held in place by circlips 84 received in respective grooves provided in the rod adjacent opposite outer sides of the latches. A further groove 86 is provided in the rod 82 midway between the latches 78 and 80. A horizontal, U-shaped, spring mounting bracket 88 has opposite, fore-and-aft extending legs 90R and 90L respectively overlying, and having forward ends coupled to, the wedge members 52R and 52L by fasteners 92 which serve also to couple the bracket and wedge members to opposite end regions of the cross shaft 54. Rear ends of the legs 90R and 90L are joined by a transverse connecting portion 94 containing a spring end mounting hole 96 located in fore-and-aft alignment with the annular groove 86 provided in the rod 82. A coil tension spring 98 has front and rear ends respectively formed into front and rear hooks respectively engaged with the annular rod groove 86 and with the hole 96 in the leg connecting portion 94, with the spring being under tension for continuously biasing the latches 78 and 80 downward and respectively into parallel, fore-and-aft extending guide slots 100 and 102 provided in the transverse plate 66. As can best be seen in FIGS. 4 and 6, respective roll pins 104 and 106 project crosswise through lower regions of the latches 78 and 80 and engage an upper surface of the transverse plate 66 in bridging relationship to the slots 100 and 102 so as to serve as downstops for limiting downward pivoting movement of the latches 78 and 80. The latches 78 and 80 form part of a secondary lock arrangement and, when positioned for retaining the quick coupler 30 in locked engagement with the bucket mounting bracket 12, have respective lower rear vertical surfaces 108 and 110 (see FIG. 5) respectively positioned in engagement with rear end surfaces 112 and 114 respectively of the guide slots 100 and 102. A fore-and-aft extending, single-acting hydraulic cylinder 116 includes a piston rod 118 having a cross tube 120 joined to its forward end and received on a connecting pin 122 extending between the latches 78 and 80 and having opposite ends projecting through axially aligned holes provided in the latches at locations which are spaced down and to the rear from the cross shaft 54 when the piston rod 118 is fully extended, as shown in FIGS. 4 and 7. The connecting pin 122 is kept in place by a pair of circlips 123 (only the right one being shown) provided in grooves in the pin respectively located adjacent outer surfaces of the latches 78 and 80 and thus secures the latches for being pivoted about the cross shaft 54 by extending or retracting the piston rod 118. As can best be seen in FIGS. 4, 6 and 7, the hydraulic cylinder 116 includes a barrel 124 having a rear end received in a cylindrical cup 126 located between a pair of fore-and-aft extending, upright mounting plates 128R and 128L having lower edges fixed to the transverse plate 66, with the cup 126 being provided with diametrically opposite, transversely projecting mounting pins 130 respectively received in rearwardly opening, U-shaped notches 132 provided in respective vertical rear edges of the plates 128R and 128L. The notches 132 are closed by the L-shaped plate 72 which is fixed in engagement with inner side locations adjacent rear and top edges of the plates 128R and 128L. Thus, the cup 126 is mounted for permitting the hydraulic cylinder 116 when extending or contracting to pivot vertically about a horizontal, transverse axis defined by the pins 130. Referring to FIGS. 5 and 6, it can be seen that the hydraulic cylinder 116 is provided with a hydraulic fluid coupling 134 located in a forward underside region of the cylinder barrel 124. A fore-and-aft elongated, keyhole shaped slot 136 is provided in the transverse plate 66 at a centered location beneath the hydraulic cylinder 116 for providing access for coupling a fluid supply/return line to the fluid coupling 134.

The operation of the latch mechanism 50 will now be described. Assuming the quick coupler 30 to be secured to the bucket 10, as shown in FIG. 1, the hydraulic cylinder 116 will be in a non-pressurized state, with the coil compression springs 74 and 76 being compressed between the upright plate 64 and the rear sides of the wedge members 52R and 52L so as to resiliently resist rearward movement of the wedge sections 48R and 48L respectively from the wedge shaped recesses 20 provided in the rear ends of the upright plates 14R and 14L of the bucket mounting bracket 12 and thereby act to effect a primary lock between the quick coupler 30 and the bucket mounting bracket 12. At the same time, the coil tension spring 98 will resiliently urge the latches 78 and 80 downwardly about the axis of the cross shaft 54 with the respective vertical rear surfaces 108 and 110 of the latches being held in engagement with the rear end surfaces 112 and 114 of the guide slots 102 and 104 to effect a secondary lock between the quick coupler and bucket mounting bracket. The secondary lock, which is effected by the tension spring 98, comes into play in the event that the primary retention force exerted on the wedge sections 48R and 48L by the coil compression springs 74 and 76 is somehow lost.

The hydraulic cylinder 116 is normally in a depressurized float condition, but is selectively pressurized to either effect release of the quick coupler latch mechanism 50 from the mounting bracket 12 of the bucket 10 or to place the latch mechanism 10 in a condition permitting the quick coupler 30 to be attached to the mounting bracket 12 of the bucket or to a similar mounting bracket of another work attachment. Accordingly, if it is desired that the bucket 10 be detached from the quick coupler 30, an operator seated in the cab of the excavator will actuate the hydraulic cylinder 116 by effecting the routing of pressure fluid to the cylinder 116 for causing it to retract and withdraw the wedge elements 48R and 48L from the wedge-shaped recesses 20. Actuation of the cylinder 116 is initiated by operation of a rocker switch 232 followed by operation of a joystick 234, each shown in FIG. 8 and described in further detail below. Because the latches 78 and 80 are then seated, or near to being seated, against the rear ends of the slots 100 and 102, initial rearward movement of the piston rod 118 will cause a rearward and upward force to be exerted on the latches 78 and 80 that overcomes the biasing force exerted by the coil tension spring 98 and causes the vertical surfaces 108 and 110 to slide upward along the end surfaces 112 and 114 of the slots 100 and 102, with the cylinder barrel 124 pivoting upwardly about the mounting pins 128 of the cup 126. When the hydraulic cylinder 116 has pivoted upward an amount sufficient to be centered along a line of centers passing through the cross shaft 54, connecting pin 122 and the pivot axis defined by the mounting pins 128, the bottom ends of the latches 82 and 84 will move out of the slots 100 and 102 so as to permit the entire latch assembly including the cross shaft 54, wedge members 52R and 52L and latch members 78 and 80 to move rearwardly against the biasing force of the coil compression springs 74 and 76, thus resulting in the wedge sections 48R and 48L being withdrawn from the wedge shaped recesses 20. At this time, the spring guide rods 56 and 58 will project rearwardly through the holes 68 and 70 in the upright portion of the L-shaped plate 72.

Removal of the quick coupler 30 can then be completed by rocking the quick coupler upwardly about the axis C1 so as to remove the wedge-shaped sections 42 and 44 of the sleeves 38 and 40 from the bucket bracket recesses 18, and then by shifting the quick coupler forwardly to remove the sleeves 34 and 36 from the C-shaped bucket recesses 16, noting that pressure fluid can be released from the hydraulic cylinder 116 as soon as the wedge sections 48R and 48L are clear of the rear end of the bracket 12. The quick coupler 30, which is carried at the end of an excavator boom or arm, can then be used for securing a different implement or tool to the excavator arm or boom, with the only requirement being that the particular implement or tool be equipped with a mounting bracket like the mounting bracket 12 and that the hydraulic cylinder 116 be pressurized to move the latching pawls 78 and 80 and the wedge members 52R and 52L to their respective upwardly pivoted and rearward positions, with the wedge members then being out of the way for permitting the quick coupler 30 to be properly positioned relative to the mounting bracket of a work attachment being coupled to the quick coupler for first permitting the coupler sleeves 34 and 36 to be placed in the C-shaped recesses in the forward end of the mounting bracket and then for the coupler to be pivoted downwardly about the axis C1 to place the wedge shaped sections 42 and 44 to into the upwardly opening, complimentary shaped recesses 18. The hydraulic cylinder 116 is then depressurized so as to permit the wedge-shaped members 52R and 52L to be shifted forwardly into wedged engagement with complimentary shaped recesses located in the rear edges of the attachment bracket by the coil compression springs 74 and 76.

Figure 8:
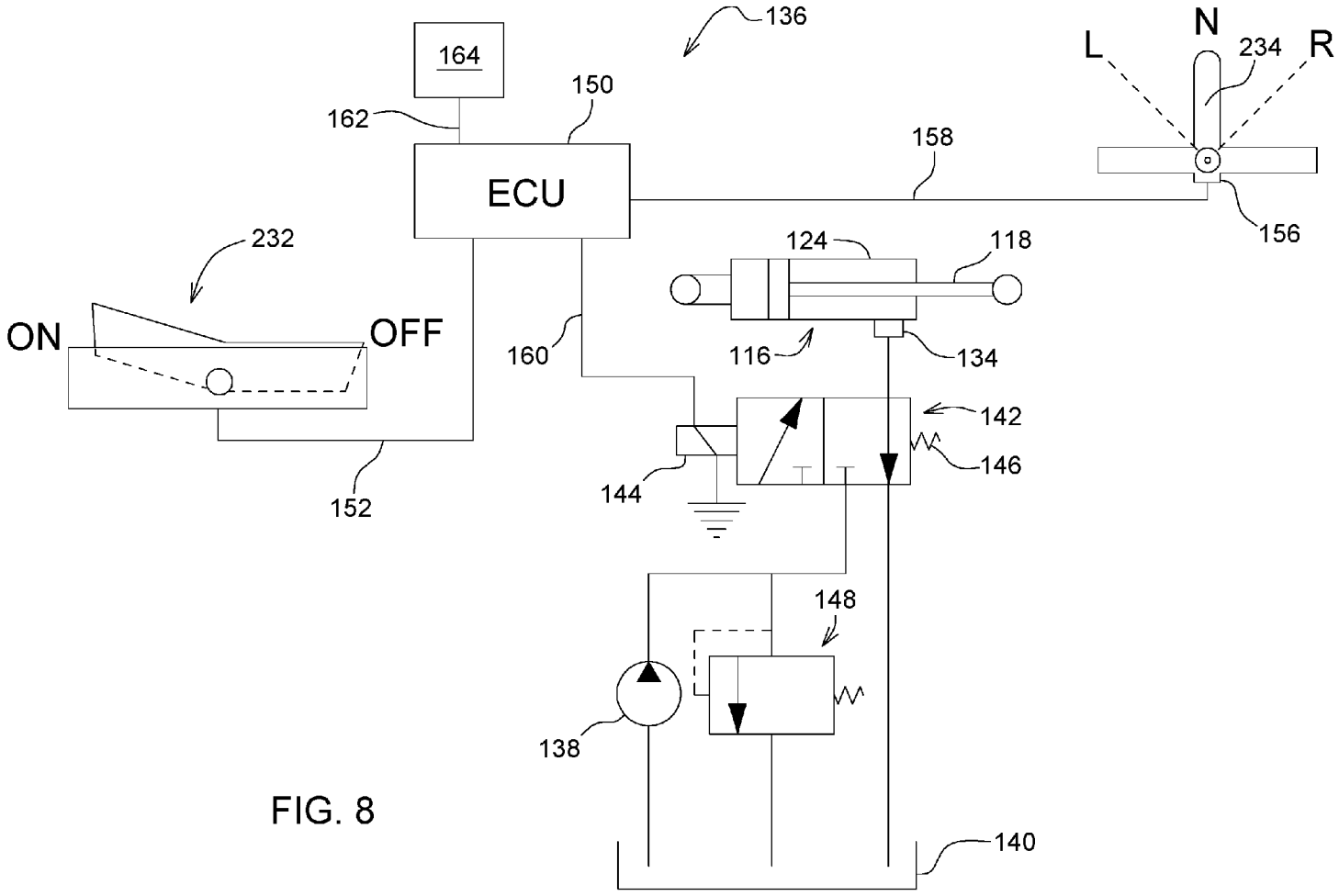
FIG. 8 is a schematic electro-hydraulic control circuit for effecting operation of the latch operating hydraulic cylinder of the quick coupler.

Referring now to FIG. 8, there is schematically shown an electro-hydraulic control circuit 136 for selectively actuating the hydraulic cylinder 116 for effecting disengagement of the quick coupler 30 from the excavator bucket 10 or any other implement attached to an excavator boom or arm using the coupler. The control circuit 136 includes a source of fluid pressure represented by a fixed displacement pump 138 having an inlet connected to a sump 140 and an outlet connected to a solenoid operated, three-way, two-position direction control valve 142, which, in turn, is coupled to the fluid coupling 134 of the hydraulic cylinder 116. The valve 142 includes a solenoid 144 and a biasing spring 146 respectively at opposite ends of the valve. The solenoid 142 is normally deactivated, with the spring 146 acting to yieldably hold the valve 142 in a normal first position wherein the outlet of the pump 138 is connected to a blocked valve port and wherein the cylinder fluid coupling 134 is connected in fluid communication with the sump 140. A pressure relief valve 148 is provided for routing the output of the pump 138 to the sump 140 when the control valve 142 is in this deactivated condition.

An electronic control unit (ECU) 150 is connected for receiving manually induced signals from the rocker switch 232 and the joystick 234. The rocker switch 232 serves as an initiating control switch and is coupled for sending a initiating control signal to the ECU 150 by an initiating control signal lead 152 in response to the rocker switch being rocked from an illustrated OFF position to an ON position. The joystick 234 is associated with an electrical position sensing device 156 which senses the position of the joystick 234 and is coupled to the ECU by a primary control signal lead 158 over which the control device 154 sends a primary control signal only in response to the joystick being moved to a pre-selected position, such as a leftward position L from an illustrated neutral position N, for example, after the rocker switch 232 has been rocked to its ON position. The ECU 150 is configured for sending a valve control signal over a valve control signal lead 160 coupled between the ECU 150 and the solenoid 144 of the direction control valve 142 only in response to the joystick 234 being manipulated for causing the primary control signal to be sent to the ECU 150 after the initiating control signal has been received by the ECU 150 as a result of the rocker switch 232 being rocked to its ON position. Thus, by requiring both the rocker switch 232 and the joystick 234 to be operated with the joystick operation following that of the rocker switch, unintentional actuation of the hydraulic cylinder 116, and, hence, unintentional unlatching of the quick coupler 30 from the attached bucket 10 is prevented or greatly minimized. Upon the solenoid 144 being energized by receiving the primary control signal, the direction control valve 142 will shift rightward so as to couple the output of the pump 138 to the hydraulic cylinder 116 causing it to retract and unlatch the quick coupler 30 from the bucket 10, as previously described. When the ECU 150 sends the primary control signal for energizing the solenoid 144, a timing circuit of the ECU 150 is initiated and when a pre-set time sufficient for the hydraulic actuator 116 to become fully retracted has elapsed, the timing circuit will time out and the ECU will send a notification signal over a notification signal lead 162 to energize a notification device 164, such as a light and/or horn so that the operator is alerted that the quick coupler 30 has been detached from the bucket 10 and that the rocker switch 232 needs to be reset to its normally OFF position. At the same time, the valve control signal will be terminated to de-energize the solenoid 144 so that the valve 142 returns to its normal position disconnecting the pump from the fluid coupling 134 leading to the working chamber of the barrel 124 of the hydraulic cylinder 116 while coupling the barrel to the sump 140 so as to permit the piston rod 118 to be extended under the biasing force of the springs 74 and 76.

While the above describes an example embodiment of the present disclosure, this description should not be viewed in a limiting sense. Rather, there are several variations and modifications which may be made without departing from the scope of the present invention as defined in the appended claims.

What is claimed is:

1. A quick coupler adapted for coupling a work implement to an arm carried by a work machine, the quick coupler comprising:

a pair of parallel, transversely spaced, vertical side plates each having rear and bottom edges and being joined together by transverse plate having opposite side edges located adjacent said rear and bottom edges of said side plates;

a latch mechanism including a cross shaft extending between, and having opposite ends disposed adjacent to, said vertical side plates at respective locations spaced forward from the rear edges of said vertical side plates, first and second wedge members respectively having forward ends fixed to opposite end regions of said cross shaft, at least one upright latch pivotally mounted to said cross shaft and a hydraulic cylinder having opposite ends respectively pivotally connected to said at least one latch and to said transverse plate;

said pair of vertical side plates respectively including fore-and-aft extending guide slots located beside said first and second wedge members, and said first and second wedge members respectively having first and second wedge sections extending transversely through said first and second guide slots and respectively having first and second forwardly converging wedge surfaces;

a first biasing spring arrangement being disposed for biasing said first and second wedge members forwardly for respectively engaging the first and second wedge sections into locking engagement with respective wedge-shaped recesses in a mounting bracket of a work implement, whereby the first and second wedge members and said first biasing spring arrangement form part of a primary lock securing the quick coupler to the work implement mounting bracket;

said transverse plate being provided with at least a third guide slot, with said third guide slot being oriented in fore-and-aft alignment with, and receiving a lower end region of, said at least one upright latch when said quick coupler is locked in engagement with the work implement bracket, with an end of said third guide slot and an upright rear surface of said at least one latch being disposed in confronting relationship to each other for engaging each other to effect a secondary lock for preventing disengagement of the wedge member wedge sections from the respective wedge-shaped recesses provided in the work implement bracket in the event that insufficient retention force is applied to the wedge members by the first biasing spring arrangement;

a second biasing spring arrangement being coupled to said at least one upright latch and, as viewed looking towards a right end of said cross shaft, tending to bias said at least one latch counterclockwise about said cross shaft, with said at least one latch being provided with a downstop limiting counterclockwise movement of the at least one latch and, hence limiting forward movement of the lower end region of said at least one latch so as to properly dispose the rear surface of the at least one latch for locking engagement with the rear end of the third guide slot; and the hydraulic cylinder being coupled to said at least one latch at a location below said cross shaft and being selectively pressurized to effect contraction so as to cause said at least one upright latch to pivot clockwise about said cross shaft in opposition to the second biasing spring arrangement with such contraction initially elevating the lower end region of the at least one latch from said third guide slot and then causing the wedge members to move rearwardly when the hydraulic cylinder lies along a line of action passing through the cross shaft, this movement of the wedge members being sufficient for them to be disengaged from the wedge-shaped recesses of the work implement bracket when it is desired to disengage the quick coupler from the working implement.

2. The quick coupler, as defined in claim 1, further including an upright plate extending transversely between rear regions of said side plates; and said first spring arrangement including first and second coil compression springs respectively compressed between said upright plate and said first and second wedge members.

3. The quick coupler, as defined in claim 2, and further including first and second spring guide rods respectively received within said first and second coil compression springs, with forward ends of said first and second guide rods respectively being joined to said first and second wedge members.

4. The quick coupler, as defined in claim 1, wherein said down stop is a roll pin positioned for engaging the transverse plate and bridging said third guide slot when the at least one upright latch is in a position for effecting said secondary lock.

5. The quick coupler, as defined in claim 1, wherein a second upright latch identical to said at least one upright latch is disposed in parallel relationship to said at least one upright latch and is mounted for pivoting about said cross shaft at a location spaced transversely from said at least one upright latch; and a fourth guide slot being provided in said transverse plate in parallel relationship to said third guide slot and being provided in fore-and-aft alignment with said second upright latch and receiving a lower end region of said second upright latch; and said second spring biasing arrangement acting on said second upright latch and tending to bias the second latch in a counterclockwise pivotal movement about said cross shaft.

6. The quick coupler, as defined in claim 5, wherein said second spring biasing arrangement is a fore-and-aft extending coil tension spring located between and having a forward end coupled to, an upper region of each of said first and second upright latches which is located at a level above the cross shaft; a fore-and-aft extending mounting bracket having a forward end coupled to said cross shaft and a rear end located behind, and coupled to a rear end of said coil tension spring.

7. The quick coupler, as defined in claim 6, wherein a transverse spring mounting rod has opposite ends respectively received in first and second transverse holes respectively provided at said upper regions of the first and second upright latches; said spring mounting rod having a groove formed therein at a location between the first and second upright latches; and the forward end of said coil tension spring being defined by a hook received in said groove.

8. The quick coupler, as defined in claim 6, wherein said mounting bracket is defined by a forwardly opening U-shaped member having first and second, fore-and-aft extending, legs having respective forward ends coupled to opposite end regions of said cross shaft, the legs having rear ends joined by a leg connecting portion; and said rear end of the coil tension spring being defined by a rear hook engaged with said leg connecting portion.

9. The quick coupler, as defined in claim 8, wherein said forward ends of said legs of the U-shaped member are coupled to said cross shaft by first and second fasteners which extend through said first and second wedge members.

10. The quick coupler, as defined in claim 1, wherein the hydraulic cylinder includes a piston rod having a forward end pivotally coupled to the at least one latch member and includes a barrel having an end pivotally coupled to the transverse plate.

11. The quick coupler, as defined in claim 5, wherein the hydraulic cylinder includes a piston rod having a cross tube at its forward end located between the at least one and second latches; a connecting pin extending through said at least one and second latches and said cross tube and pivotally connecting the piston rod to the at least one and second latches; and said hydraulic cylinder including a cylinder barrel having a rear end pivotally connected to said transverse plate.

12. The quick coupler, as defined in claim 11, wherein the pivotal connection between the rear end of the cylinder barrel and the transverse plate is effected, at least in part, by a cylindrical cup receiving the rear end of the cylinder barrel and transverse mounting pins joined to the cylindrical cup.

13. The quick coupler, as defined in claim 1, wherein an electro-hydraulic circuit is provided for selectively activating the normally deactivated hydraulic cylinder for supplying the hydraulic cylinder with pressurized fluid, the electro-hydraulic circuit including an electrical control unit (ECU); a first switch coupled for sending an initiating control signal to the ECU when the first switch is moved to an ON position; a control device coupled to the ECU and movable to an actuating position for sending a primary control signal to the ECU after the first switch is moved to its ON position; a normally deactivated solenoid-operated, three way, two position direction control valve coupled in a hydraulic fluid supply line extending between a source of pressure fluid and a hydraulic fluid coupling of a barrel of the cylinder; a valve control lead coupled between the ECU and a solenoid of the solenoid-operated control valve; said ECU being configured for sending a valve energizing signal for energizing the control valve only after the first switch has been operated for sending the initiating signal followed by the control device being operated for sending the primary control signal, thereby preventing unintentional actuation of the hydraulic cylinder.

14. A spring applied, hydraulically released quick coupler, comprising: right and left, parallel, fore-and-aft extending, upright side plates having bottom regions secured together by a transverse plate; a lock arrangement located entirely between approximately a rear half of a length of the right and left, upright side plates and including:

a cross shaft at a forward end of the lock arrangement having opposite ends respectively located adjacent said right and left upright side plates;

a wedge arrangement including right and left wedge members respectively secured to opposite end regions of the cross shaft and having respective outward projecting, forwardly converging, wedge shaped portions respectively received in first and second wedge guide slots respectively extending fore-and-aft in said right and left upright side plates and supporting the wedge members and cross shaft for fore-and-aft movement above said transverse plate;

at least one latching pawl being pivotally mounted to said cross shaft at a location between said wedge members and having a lower end region located in a first fore-and-aft extending pawl guide slot provided in said transverse plate, with a rear end of the pawl guide slot defining an upright abutment surface disposed for engaging a confronting pawl surface when the pawl is in a secondary lock position for preventing rearward movement of said wedge members;

a first spring arrangement mounted for biasing said wedge members forwardly in said first and second wedge guide slots;

a second spring arrangement mounted for biasing said at least one latching pawl in a direction for resisting pivotal movement of said at least one latching pawl from said first pawl guide slot; and a hydraulic cylinder having a rod coupled to said at least one latching pawl at a location below said cross shaft and being operable when selectively pressurized to cause said at least one latching pawl to be pivoted upwardly against a biasing force of the second spring arrangement and withdrawn from the pawl guide slot and then for causing the wedge members to be shifted rearwardly to a lock release position.

15. The quick coupler, as defined in claim 14, wherein said first spring arrangement includes a spring guide rod fixed to, and projecting rearward from each of said right and left wedge members and a coil compression spring being located on each of said rods and compressed between a fixed upright plate adjacent a rear location of the quick coupler and a respective one of the wedge members.

16. The quick coupler, as defined in claim 14, wherein said second spring arrangement includes a spring support member fixed to, and projecting rearwardly from, the cross shaft, a spring mounting rod extending crosswise through the at least one latching pawl at a location above said cross shaft and a coil tension spring being coupled between a rear location of the spring support member and said spring mounting rod.

17. The quick coupler, as defined in claim 16, wherein a second latching pawl identical to said at least one latching pawl is pivotally mounted to said cross shaft at a location spaced transversely from said at least one latching pawl and has a lower region located in a second pawl slot extending parallel in said transverse plate to said pawl slot and said spring mounting rod also extending through said second latching pawl.

18. The quick coupler, as defined in claim 14, wherein a cylinder connecting pin extends through said at least one latching pawl at a location below said cross shaft and said hydraulic cylinder including a piston rod coupled to said cylinder connecting pin.

19. The quick coupler, as defined in claim 18 wherein a second latching pawl identical to said at least one latching pawl is pivotally mounted to said cross shaft in transverse spaced relationship to said at least one latching pawl and has a lower region projecting downwardly into a second pawl guide slot extending parallel to said pawl guide slot.

20. The quick coupler, as defined in claim 18, wherein said hydraulic cylinder includes a barrel having a rear end mounted for pivoting about a transverse axis having a height approximately equal to that of said cross shaft, whereby upward pivotal movement of said at least one latching pawl about said cross shaft will be effected upon the hydraulic cylinder being pressurized to retract, with the pivotal movement of the at least one latching pawl ceasing when the connection of the cylinder rod with the at least one latching pawl and the connection of the rear of the cylinder are in alignment with the cross shaft, with further retraction of the cylinder resulting in rearward movement of the cross shaft together with the wedge members.

21. The quick coupler, as defined in claim 18, wherein the hydraulic cylinder includes a barrel; a cylindrical cup being received on a rear end of the barrel and being mounted for pivoting about a transverse axis having a height approximately equal to that of said cross shaft, whereby upward pivotal movement of said at least one latching pawl about said cross shaft will be effected when upon the hydraulic cylinder being pressurized to retract, with the pivotal movement of the at least one latching pawl ceasing when the connection of the cylinder rod with the at least one latching pawl and the connection of the rear of the cylinder are in alignment with the cross shaft, with further retraction of the cylinder resulting in rearward movement of the cross shaft together with the wedge members.

22. The quick coupler, as defined in claim 19, wherein a downstop arrangement is associated with said at least one and second latching pawls for maintaining the latching pawls correctly disposed for having their confronting surfaces engage the rear ends of the first and second latch pawl guide slots so as to effect said secondary lock in the event that insufficient force is exerted for maintaining the wedge members properly seated in wedge-shaped recesses provided in a mounting bracket of an attachment when in quick-coupler is in locked engagement with the mounting bracket.

* * * * *